US009228751B2

(12) United States Patent
Sakai et al.

(10) Patent No.: US 9,228,751 B2
(45) Date of Patent: Jan. 5, 2016

(54) HUMIDITY CONTROLLING VENTILATOR

(75) Inventors: Gakuto Sakai, Osaka (JP); Akihiro Eguchi, Osaka (JP); Tomohiro Yabu, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 268 days.

(21) Appl. No.: 14/005,748

(22) PCT Filed: Apr. 2, 2012

(86) PCT No.: PCT/JP2012/002299

§ 371 (c)(1),
(2), (4) Date: Sep. 17, 2013

(87) PCT Pub. No.: WO2012/132478

PCT Pub. Date: Oct. 4, 2012

(65) Prior Publication Data

US 2014/0007604 A1 Jan. 9, 2014

(30) Foreign Application Priority Data

Mar. 31, 2011 (JP) ..... 2011-078437

(51) Int. Cl.
*F25B 15/00* (2006.01)
*F24F 3/14* (2006.01)
(Continued)

(52) U.S. Cl.
CPC ..... *F24F 3/1411* (2013.01); *F24F 3/1429* (2013.01); *F24F 11/0008* (2013.01); *F24F 11/04* (2013.01)

(58) Field of Classification Search
CPC ..... F24F 11/0008; F24F 11/04; F24F 3/1411; F24F 3/1429
USPC ..... 62/324.6, 92, 93, 483
See application file for complete search history.

(56) References Cited

U.S. PATENT DOCUMENTS 4,992,952 A 2/1991 Sasaki
8,628,888 B2 * 1/2014 Noto ..... 429/428
(Continued)

FOREIGN PATENT DOCUMENTS

DE 4333173 A1 3/1995
GB 2457731 A * 8/2009
(Continued)

OTHER PUBLICATIONS

International Search Report issued in PCT/JP2012/002299, dated Jun. 19, 2012.

*Primary Examiner* — Cheryl J Tyler
*Assistant Examiner* — Ana Vazquez
(74) *Attorney, Agent, or Firm* — Birch, Stewart, Kolasch & Birch, LLP

(57) ABSTRACT

The present invention is directed to a humidity controlling ventilator which takes in air through the use of an air blowing fan, and controls the humidity of the taken air via an adsorption heat exchanger prior to supplying it to the room. In the invention, the air blowing fan is controlled so as to make an air volume flow rate approach a predetermined target volume flow rate. To do this, the invention calculates the fan's air volume flow rate based on a specific volume of air downstream of the adsorption heat exchanger and an air mass flow rate of the fan. The calculated value is fed to an air blow controller that is configured to control the fan such that the calculated air volume flow rate approaches the predetermined target air volume flow rate.

6 Claims, 11 Drawing Sheets

(51) Int. Cl.
*F24F 11/00* (2006.01)
*F24F 11/04* (2006.01)

(56) References Cited

U.S. PATENT DOCUMENTS

| | | | | |
|---|---|---|---|---|
| 2002/0180448 | A1* | 12/2002 | Imamura et al. | 324/439 |
| 2007/0125115 | A1* | 6/2007 | Matsui et al. | 62/331 |
| 2010/0161135 | A1 | 6/2010 | Nerling | |

FOREIGN PATENT DOCUMENTS

| | | | |
|---|---|---|---|
| JP | 64-80464 | A | 3/1989 |
| JP | 2008-82643 | A | 4/2008 |
| JP | 2009-517624 | A | 4/2009 |
| JP | 2009-109116 | A | 5/2009 |
| JP | 2009-109134 | A | 5/2009 |
| JP | 2009-109150 | A | 5/2009 |
| JP | 2011-2131 | A | 1/2011 |
| WO | WO 95/09331 | A | 4/1995 |

* cited by examiner

HUMIDITY CONTROLLING VENTILATOR

TECHNICAL FIELD

The present invention relates to humidity controlling ventilators configured to control the humidity of taken air to supply the humidity-controlled air into a room.

BACKGROUND ART

Ventilators configured to ventilate a room have been conventionally known, and as such as ventilator, a humidity controlling ventilator configured to exhaust room air and simultaneously dehumidify outside air to supply the dehumidified air into a room has been known. PATENT DOCUMENT 1 describes a humidity controlling ventilator serving as the above-described ventilator. The humidity controlling ventilator determines the rotational speed of a fan such that the accumulated power consumed by the fan is equal to the power required to provide a previously determined target air flow rate. Specifically, in the conventional humidity controlling ventilator, the fan has been controlled based on the mass flow rate of air blown by the fan (the mass of air per unit time).

CITATION LIST

Patent Document

PATENT DOCUMENT 1: Japanese Patent Publication No. 2009-109134

SUMMARY OF THE INVENTION

Technical Problem

However, in the humidity controlling ventilator of PATENT DOCUMENT 1, when, for example, the air temperature has increased, the air volume flow rate (the volume of air per unit time) increases even with the air mass flow rate being unchanged. This excessively increases the flow rate of air flowing through a duct, thereby increasing the pressure loss. For example, when the air temperature has decreased, the air volume flow rate decreases even with the air mass flow rate being unchanged. This reduces the flow rate of air flowing through the duct, and the amount of ventilation becomes inadequate. In other words, the flow rate of air flowed by the fan cannot be kept constant due to a change in the air temperature.

It is therefore an object of the present invention to provide a humidity controlling ventilator configured to keep the flow rate of air flowed by a fan constant independently of a change in the air temperature.

Solution to the Problem

The present invention is configured to control an air blowing fan based on the air volume flow rate.

A humidity controlling ventilator according to a first aspect of the invention includes a humidity controlling member (51, 52) having an adsorbent and configured to bring the adsorbent into contact with air, and an air blowing fan (25, 26) provided downstream of the humidity controlling member (51, 52) to supply air to the humidity controlling member (51, 52), and is configured to control a humidity of taken air using the humidity controlling member (51, 52), and then supply the humidity-controlled air into a room. The humidity controlling ventilator includes: an air flow rate calculator (62) configured to calculate an air volume flow rate of the air blowing fan (25, 26) based on a specific volume of air located downstream of the humidity controlling member (51, 52) and an air mass flow rate of the air blowing fan (25, 26); and an air blow controller (63) configured to control the air blowing fan (25, 26) such that the air volume flow rate calculated by the air flow rate calculator (62) approaches a predetermined target air volume flow rate.

In the first aspect of the invention, air taken by the humidity controlling ventilator (10) is delivered to the humidity controlling member (51, 52), and is in contact with the adsorbent. In the humidity controlling member (51, 52), the moisture of the air is adsorbed by the adsorbent, or the moisture desorbed from the adsorbent is given to the air. The humidity controlling ventilator (10) supplies the air the humidity of which has been controlled by the humidity controlling member (51, 52) into the room. The humidity controlling ventilator (10) includes the air flow rate calculator (62) and the air blow controller (63).

The flow rate calculator (62) calculates the volume flow rate of air flowed by the air blowing fan (25, 26) and located downstream of the humidity controlling member (51, 52) based on the specific volume of the air located downstream of the humidity controlling member (51, 52) and the mass flow rate of the air flowed by the air blowing fan (25, 26). The air blow controller (63) controls the air blowing fan (25, 26) such that the air volume flow rate calculated by the flow rate calculator (62) approaches the predetermined target air volume flow rate. In other words, since the air blowing fan (25, 26) is controlled based on the air volume flow rate, the flow rate of air flowed by the air blowing fan (25, 26) can be controlled to remain constant even with a change in the air temperature.

According to a second aspect of the invention, in the humidity controlling ventilator of the first aspect of the invention, the air flow rate calculator (62) may be configured to calculate the specific volume of the air located downstream of the humidity controlling member (51, 52) based on a temperature and a humidity of air located upstream of the humidity controlling member (51, 52).

In the second aspect of the invention, the air flow rate calculator (62) calculates the temperature and humidity of the air located downstream of the humidity controlling member (51, 52) based on the temperature and humidity of the air located upstream of the humidity controlling member (51, 52), and calculates the specific volume of the air located downstream of the humidity controlling member (51, 52) based on the calculated temperature and humidity. In other words, the specific volume of the air located downstream of the humidity controlling member (51, 52) can be calculated without detecting the temperature and humidity of the air.

According to a third aspect of the invention, the humidity controlling ventilator of the second aspect of the invention may further include: a refrigerant circuit (50) which includes at least a compressor (53), and through which refrigerant is circulated to perform a refrigeration cycle. The humidity controlling member (51, 52) may be regenerated by utilizing heat released from the refrigerant of the refrigerant circuit (50), and the air flow rate calculator (62) may be configured to calculate the specific volume of the air located downstream of the humidity controlling member (51, 52) further based on a capacity of the compressor (53).

In the third aspect of the invention, the humidity controlling member (51, 52) is regenerated by utilizing the heat released from the refrigerant of the refrigerant circuit (50). With a change in the capacity of the compressor (53), the amount of the refrigerant circulating through the refrigerant circuit (50) changes, and the amount of heat obtained by the refrigeration cycle changes. As a result, when the amount of heat utilized to regenerate the humidity controlling member (51, 52) changes, and the amount of the moisture desorbed from the humidity controlling member (51, 52) changes, the amount of the moisture absorbed by the humidity controlling member (51, 52) then changes. Furthermore, when the amount of the heat utilized to regenerate the humidity controlling member (51, 52) changes, the temperature of air passing through the humidity controlling member (51, 52) changes, and thereafter, the temperature of air supplied into the room changes. In other words, when the capacity of the compressor (53) of the refrigerant circuit (50) is variable, the temperature of the air passing through the humidity controlling member (51, 52) changes depending on the capacity of the compressor (53).

The specific volume of the air located downstream of the humidity controlling member (51, 52) is calculated based on, not only the temperature and humidity of the air located upstream of the humidity controlling member (51, 52), but also the capacity of the compressor (53) provided within the refrigerant circuit (50).

According to a fourth aspect of the invention, in the humidity controlling ventilator of any one of the first through third aspects of the invention, the air flow rate calculator (62) may be configured to calculate the air mass flow rate of the air blowing fan (25, 26) based on at least power consumed by the air blowing fan (25, 26) and a rotational speed of the air blowing fan (25, 26).

In the fourth aspect of the invention, the flow rate calculator (62) calculates the mass flow rate of air flowed by the air blowing fan (25, 26) based on at least the power consumed by the air blowing fan (25, 26) and the rotational speed of the air blowing fan (25, 26).

According to a fifth aspect of the invention, in the humidity controlling ventilator of the third or fourth aspect of the invention, first and second adsorption heat exchangers (51, 52) on each of which an adsorbent is carried and which are connected to the refrigerant circuit (50) may be each provided as the humidity controlling member. In each of the two adsorption heat exchangers (51, 52), an adsorption action and a regeneration action of the adsorbent may be alternately performed by switching a direction of circulation of the refrigerant through the refrigerant circuit (50) between opposite directions. A humidity of air passing through each of the adsorption heat exchangers (51, 52) may be controlled.

In the fifth aspect of the invention, the refrigerant circuit (50) includes the first and second adsorption heat exchangers (51) and (52) on each of which the adsorbent is carried as humidity controlling members. In each of the two adsorption heat exchangers (51, 52), an adsorption action and a regeneration action of the adsorbent are alternately performed by switching the direction of circulation of the refrigerant through the refrigerant circuit (50) between opposite directions, and the humidity of the air passing through each of the adsorption heat exchangers (51, 52) is controlled.

Advantages of the Invention

According to the first aspect of the invention, the air flow rate of the air blowing fan (25, 26) is controlled based on the air volume flow rate, and thus, the air flow rate of the air blowing fan (25, 26) can be controlled even with a change in the temperature of air sucked by the fan.

Here, fans have been conventionally controlled based on the corresponding air mass flow rates. In this case, when the air temperature increases, and the air volume flow rate increases, the air flow rate of a corresponding fan is too high, and thus, the loss through a duct increases. On the other hand, when the air temperature decreases, and the air volume flow rate decreases, the air flow rate of the fan becomes inadequate, and thus, the amount of ventilation becomes inadequate. In other words, when the fan is controlled based on the air mass flow rate, a change in the air temperature causes the air flow rate to be too high or too low.

However, according to the present invention, since the air volume flow rate of the air blowing fan (25, 26) is brought closer to the target air volume flow rate, the flow rate of air flowed by the air blowing fan (25, 26) can be controlled to remain constant even with a change in the air temperature. This can reliably prevent the flow rate of the air flowed by the air blowing fan (25, 26) from being too high or too low due to a change in the air temperature.

According to the second and third aspects of the invention, the specific volume of the air located downstream of the humidity controlling member (51, 52) is calculated based on the temperature and humidity of the air located upstream of the humidity controlling member (51, 52); therefore, the specific volume of the air located downstream of the humidity controlling member (51, 52) can be calculated without detecting the temperature and humidity of the air. This can reduce, e.g., sensors configured to detect the temperature and humidity of the air located downstream of the humidity controlling member (51, 52).

According to the fourth aspect of the invention, the air mass flow rate of the air blowing fan (25, 26) is calculated based on the power consumed by the air blowing fan (25, 26) and the rotational speed of the air blowing fan (25, 26); therefore, the air mass flow rate of the air blowing fan (25, 26) can be easily and reliably calculated.

According to the fifth aspect of the invention, the air flow rate of the air blowing fan (25, 26) is controlled based on the air volume flow rate; therefore, even when air passes through each of the adsorption heat exchangers (51, 52), and the air temperature changes, the flow rate of the air flowed by the air blowing fan (25, 26) can be controlled. This can reliably prevent the flow rate of the air flowed by the air blowing fan (25, 26) from being too high or too low due to a change in the air temperature.

BRIEF DESCRIPTION OF THE DRAWINGS

FIG. 5(A) illustrates a first normal operation, and FIG. 5(B) illustrates a second normal operation.

DESCRIPTION OF EMBODIMENTS

Figure 1:
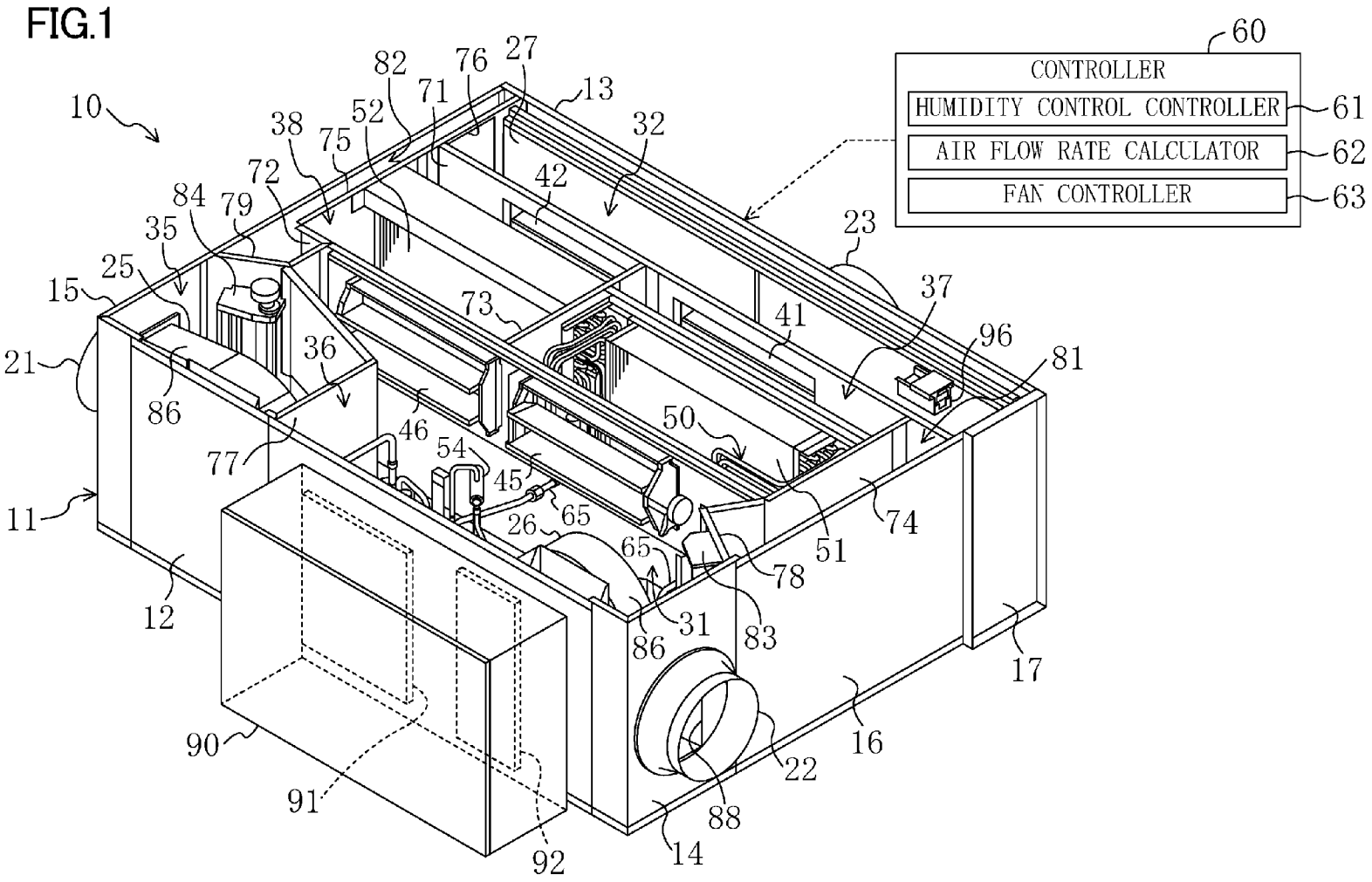
FIG. 1 is a perspective view illustrating a humidity controlling ventilator as viewed from the front surface side, omitting a top plate of a casing.
Figure 2:
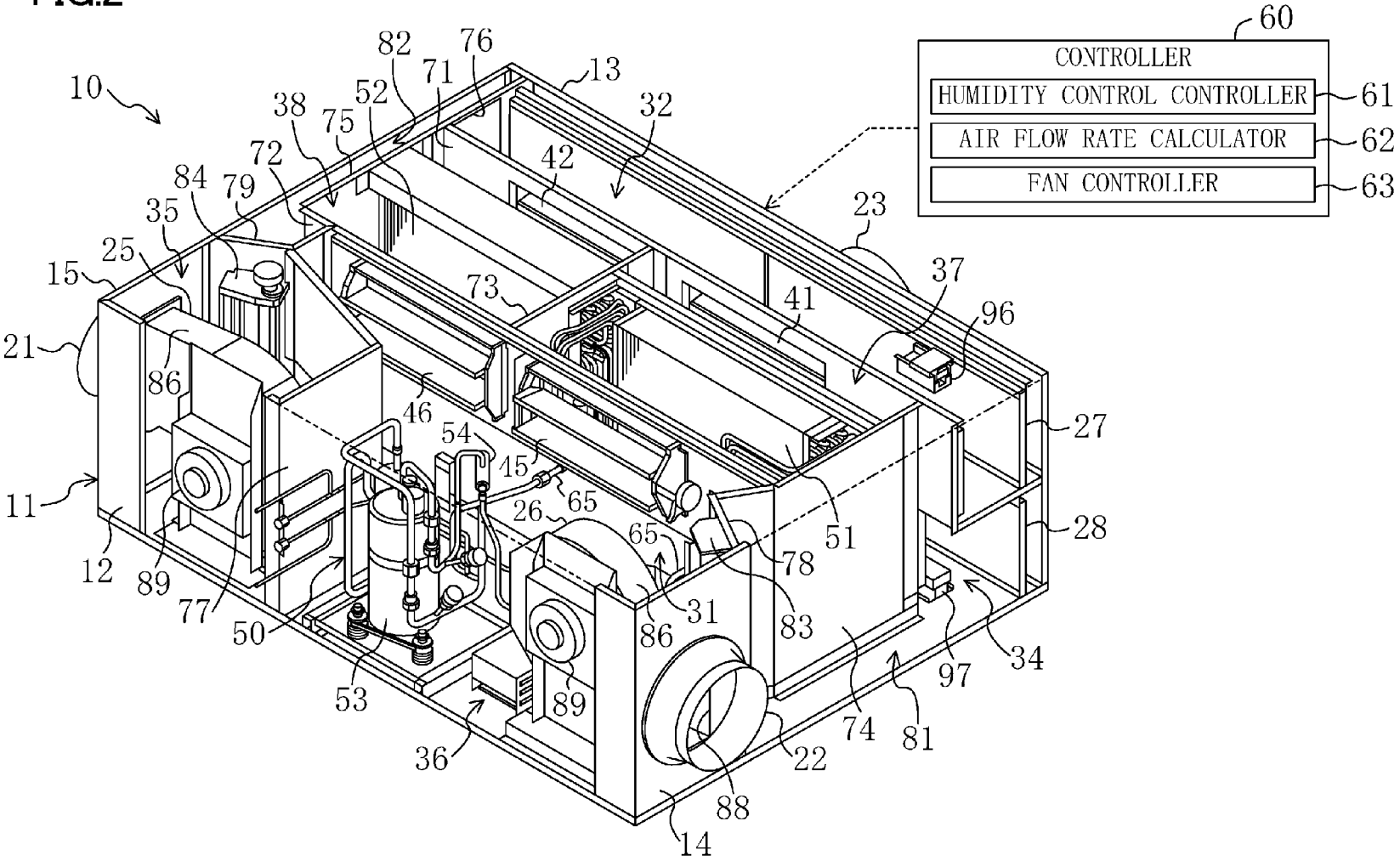
FIG. 2 is a perspective view illustrating the humidity controlling ventilator as viewed from the front surface side, omitting a part of the casing and an electrical component box.
Figure 3:
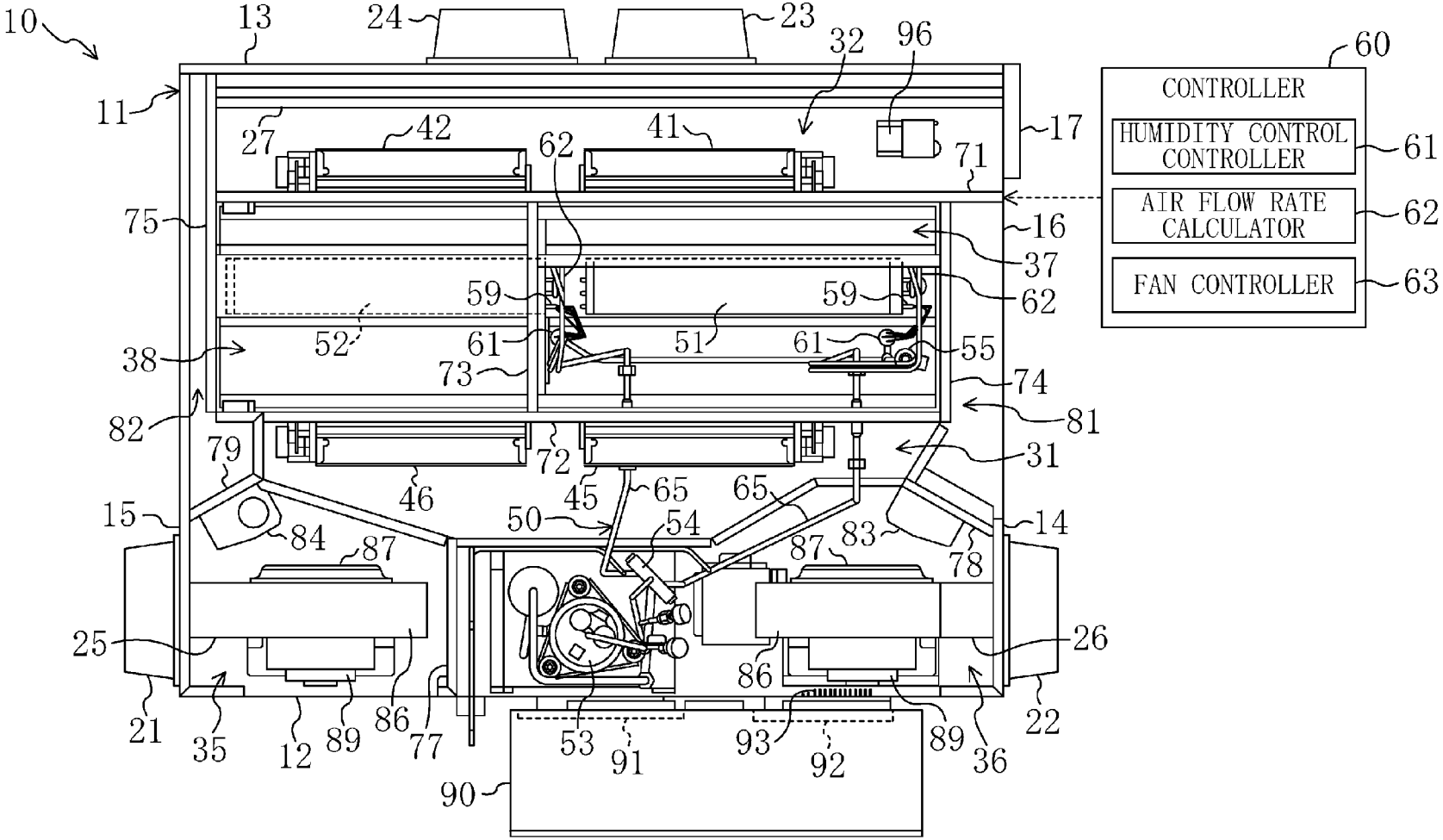
FIG. 3 is a plan view illustrating the humidity controlling ventilator, omitting the top plate of the casing.

An embodiment of the present invention will be described in detail hereinafter with reference to the drawings. A humidity controlling ventilator (10) of this embodiment is configured to control the humidity of room air while also ventilating the room, control the humidity of taken outside air (OA) to supply the humidity-controlled air into the room while simultaneously discharging taken room air (RA) to the outside. An unshown air conditioner is also provided in a target room for the humidity controlling ventilator (10). In other words, in the room, the room humidity is controlled by the humidity controlling ventilator (10), and the room temperature is simultaneously controlled by the air conditioner. That is, the humidity controlling ventilator (10) and the air conditioner form an air conditioning system configured to handle latent and sensible heat in a room at the same time.

<Entire Configuration of Humidity Controlling Ventilator>

The humidity controlling ventilator (10) will be described with reference to FIGS. 1-4 as necessary. Note that the terms "upper," "lower," "left," "right," "front," "rear," "near" and "far" as used herein refer to the corresponding directions as the humidity controlling ventilator (10) is viewed from the front surface side.

The humidity controlling ventilator (10) includes a casing (11). A refrigerant circuit (50) is accommodated in the casing (11). A first adsorption heat exchanger (51), a second adsorption heat exchanger (52), a compressor (53), a four-way switching valve (54), and an electric expansion valve (55) are connected to the refrigerant circuit (50). The details of the refrigerant circuit (50) will be described below.

The casing (11) is formed in a rectangular parallelepiped shape that is slightly flattened and has a relatively low height. A portion of the casing (11) forming the near left side surface in FIG. 2 (i.e., the front surface) is a front surface panel portion (12), and a portion thereof forming the far right side surface in the figure (i.e., the rear surface) is a rear surface panel portion (13). A portion of the casing (11) forming the near right side surface in the figure is a first side surface panel portion (14), and a portion thereof forming the far left side surface in the figure is a second side surface panel portion (15).

The casing (11) is provided with an outside-air inlet (24), a room-air inlet (23), an air supply opening (22), and an exhaust opening (21). The outside-air inlet (24) and the room-air inlet (23) are opened in the rear surface panel portion (13). The outside-air inlet (24) is placed in a lower portion of the rear surface panel portion (13). The room-air inlet (23) is placed in an upper portion of the rear surface panel portion (13). The air supply opening (22) is placed near an end portion of the first side surface panel portion (14) toward the front surface panel portion (12). The exhaust opening (21) is placed near an end portion of the second side surface panel portion (15) toward the front surface panel portion (12).

In the internal space of the casing (11), an upstream-side partition (71), a downstream-side partition (72), a center partition (73), a first partition (74), and a second partition (75) are provided. These partitions (71-75) are each provided upright on a bottom plate of the casing (11) to partition the internal space of the casing (11) from the bottom plate to a top plate of the casing (11).

The upstream-side partition (71) and the downstream-side partition (72) are placed in an orientation parallel to the front surface panel portion (12) and the rear surface panel portion (13), and are spaced a predetermined distance apart from each other in a front-rear direction of the casing (11). The upstream-side partition (71) is placed closer to the rear surface panel portion (13), and the downstream-side partition (72) is placed closer to the front surface panel portion (12).

The first and second partitions (74) and (75) are placed in an orientation parallel to the first and second side surface panel portions (14) and (15). The first partition (74) is placed a predetermined distance apart from the first side surface panel portion (14) to cover the space between the upstream-side partition (71) and the downstream-side partition (72) from the right side. The second partition (75) is placed a predetermined distance apart from the second side surface panel portion (15) to cover the space between the upstream-side partition (71) and the downstream-side partition (72) from the left side.

The center partition (73) is placed between the upstream-side partition (71) and the downstream-side partition (72) in an orientation perpendicular to the upstream-side partition (71) and the downstream-side partition (72). The center partition (73) extends from the upstream-side partition (71) to the downstream-side partition (72) to partition the space between the upstream-side partition (71) and the downstream-side partition (72) into left and right portions.

In the casing (11), the space between the upstream-side partition (71) and the rear surface panel portion (13) is partitioned into two, upper and lower, spaces. Of the upper and lower partitioned spaces, the upper space forms a room air-side passageway (32), and the lower space forms an outside air-side passageway (34). The room air-side passageway (32) communicates with the room via a duct connected to the room-air inlet (23). The room air-side passageway (32) is provided with a room air-side filter (27), a room air humidity sensor (96), and a room air temperature sensor (98). The room air temperature sensor (98) and the room air humidity sensor (96) are configured to measure the temperature and humidity, respectively, of the air (RA) located upstream (on the primary side) of the adsorption heat exchangers (51, 52) and sucked from the room. The outside air-side passageway (34) communicates with the outside via a duct connected to the outside-air inlet (24). The outside air-side passageway (34) is provided with an outside air-side filter (28), an outside air humidity sensor (97), and an outside air temperature sensor (99). The outside air temperature sensor (99) and the outside air humidity sensor (97) are configured to measure the temperature and humidity, respectively of the air (OA) located upstream (on the primary side) of the adsorption heat exchangers (51, 52) and sucked from the outside. The room air temperature sensor (98) and the outside air temperature sensor (99) are not shown, but shown in FIG. 4. The room air humidity sensor (96) detects the relative humidity of the room air, and the outside air humidity sensor (97) detects the relative humidity of the outside air.

The space in the casing (11) between the upstream-side partition (71) and the downstream-side partition (72) is partitioned by the center partition (73) into left and right portions. The space on the right side of the center partition (73) forms a first heat exchanger chamber (37), and the space on the left side of the center partition (73) forms a second heat exchanger chamber (38). The first adsorption heat exchanger (51) is accommodated in the first heat exchanger chamber (37). The second adsorption heat exchanger (52) is accommodated in the second heat exchanger chamber (38). Although not shown, the electric expansion valve (55) of the refrigerant circuit (50) is accommodated in the first heat exchanger chamber (37).

The adsorption heat exchangers (51, 52) are adsorption members for bringing an adsorbent in contact with the air, and form humidity controlling members according to the present invention. The adsorption heat exchangers (51, 52) are so-called cross-fin-type fin-and-tube heat exchangers on the surface of which the adsorbent is carried, and each of the adsorption heat exchangers (51, 52) as a whole is formed in a rectangular thick plate shape or a flattened rectangular parallelepiped shape. The adsorption heat exchangers (51, 52) are provided upright in the corresponding heat exchanger chambers (37, 38) in an orientation such that their front and rear surfaces are parallel to the upstream-side partition (71) and the downstream-side partition (72). For example, zeolite, silica gel, or their mixture is used as the adsorbent carried on the adsorption heat exchangers (51, 52).

A portion of the internal space of the casing (11) along the front surface of the downstream-side partition (72) is partitioned into upper and lower portions. Of the upper and lower partitioned spaces, the upper space forms an air-supply-side passageway (31), and the lower space forms an exhaust-side passageway (33).

The upstream-side partition (71) is provided with four dampers (41-44) that can be opened/closed. Each of the dampers (41-44) is generally formed in a horizontally-oriented rectangular shape. Specifically, in a portion (upper portion) of the upstream-side partition (71) that is facing the room air-side passageway (32), the first room air-side damper (41) is attached on the right of the center partition (73), and the second room air-side damper (42) is attached on the left of the center partition (73). In a portion (lower portion) of the upstream-side partition (71) that is facing the outside air-side passageway (34), the first outside air-side damper (43) is attached on the right of the center partition (73), and the second outside air-side damper (44) is attached on the left of the center partition (73).

The downstream-side partition (72) is provided with four dampers (45-48) that can be opened/closed. Each of the dampers (45-48) is generally formed in a horizontally-oriented rectangular shape. Specifically, in a portion (upper portion) of the downstream-side partition (72) that is facing the air-supply-side passageway (31), the first air-supply-side damper (45) is attached on the right of the center partition (73), and the second air-supply-side damper (46) is attached on the left of the center partition (73). In a portion (lower portion) of the downstream-side partition (72) that is facing the exhaust-side passageway (33), the first exhaust-side damper (47) is attached on the right of the center partition (73), and the second exhaust-side damper (48) is attached on the left of the center partition (73).

In the casing (11), the space between the air-supply-side passageway (31) and the exhaust-side passageway (33) and the front surface panel portion (12) is partitioned by a partition (77) into left and right portions. Of the left and right partitioned spaces, the space on the right side of the partition (77) forms an air supply fan chamber (36), and the space on the left side of the partition (77) forms an exhaust fan chamber (35).

The air supply fan (26) is accommodated in the air supply fan chamber (36). The exhaust fan (25) is accommodated in the exhaust fan chamber (35). The air supply fan (26) and the exhaust fan (25) are both centrifugal multiblade fans (so-called sirocco fans). The air supply fan (26) and the exhaust fan (25) form air blowing fans according to the present invention.

Specifically, these fans (25, 26) each include a fan rotor, a fan casing (86), and a fan motor (89). Although not shown in the figures, the fan rotor is formed in a cylindrical shape having an axial length that is shorter than its diameter, with many blades formed on the circumferential surface thereof. The fan rotor is accommodated in the fan casing (86). An inlet (87) is opened in one of the side surfaces (side surfaces that are perpendicular to the axial direction of the fan rotor) of the fan casing (86). The fan casing (86) is formed with a portion outwardly protruding from the circumferential surface thereof, with an outlet (88) being opened at the protruding end of that portion. The fan motor (89) is attached to a side surface of the fan casing (86) that is opposite to the inlet (87). The fan motor (89) is connected to the fan rotor to rotate the fan rotor.

In the air supply fan (26) and the exhaust fan (25), when the fan rotor is rotated by the fan motor (89), the air is sucked into the fan casing (86) through the inlet (87), and the air in the fan casing (86) is blown out of the outlet (88).

In the air supply fan chamber (36), the air supply fan (26) is placed in an orientation such that the inlet (87) of the fan casing (86) is facing the downstream-side partition (72). The outlet (88) of the fan casing (86) of the air supply fan (26) is attached to the first side surface panel portion (14) in a state where it communicates with the air supply opening (22).

In the exhaust fan chamber (35), the exhaust fan (25) is placed in an orientation such that the inlet (87) of the fan casing (86) is facing the downstream-side partition (72). The outlet (88) of the fan casing (86) of the exhaust fan (25) is attached to the second side surface panel portion (15) in a state where it communicates with the exhaust opening (21).

The compressor (53) and the four-way switching valve (54) of the refrigerant circuit (50) are accommodated in the air supply fan chamber (36). The compressor (53) and the four-way switching valve (54) are placed between the air supply fan (26) in the air supply fan chamber (36) and the partition (77).

In the casing (11), the space between the first partition (74) and the first side surface panel portion (14) forms a first bypass passageway (81). The starting end of the first bypass passageway (81) communicates only with the outside air-side passageway (34), and is blocked from the room air-side passageway (32). The terminal end of the first bypass passageway (81) is separated by a partition (78) from the air-supply-side passageway (31), the exhaust-side passageway (33), and the air supply fan chamber (36). A first bypass damper (83) is provided on a portion of the partition (78) that faces the air supply fan chamber (36).

In the casing (11), the space between the second partition (75) and the second side surface panel portion (15) forms a second bypass passageway (82). The starting end of the second bypass passageway (82) communicates only with the room air-side passageway (32), and is blocked from the outside air-side passageway (34). The terminal end of the second bypass passageway (82) is separated by a partition (79) from the air-supply-side passageway (31), the exhaust-side passageway (33), and the exhaust fan chamber (35). A second bypass damper (84) is provided on a portion of the partition (79) that faces the exhaust fan chamber (35).

Figure 4:
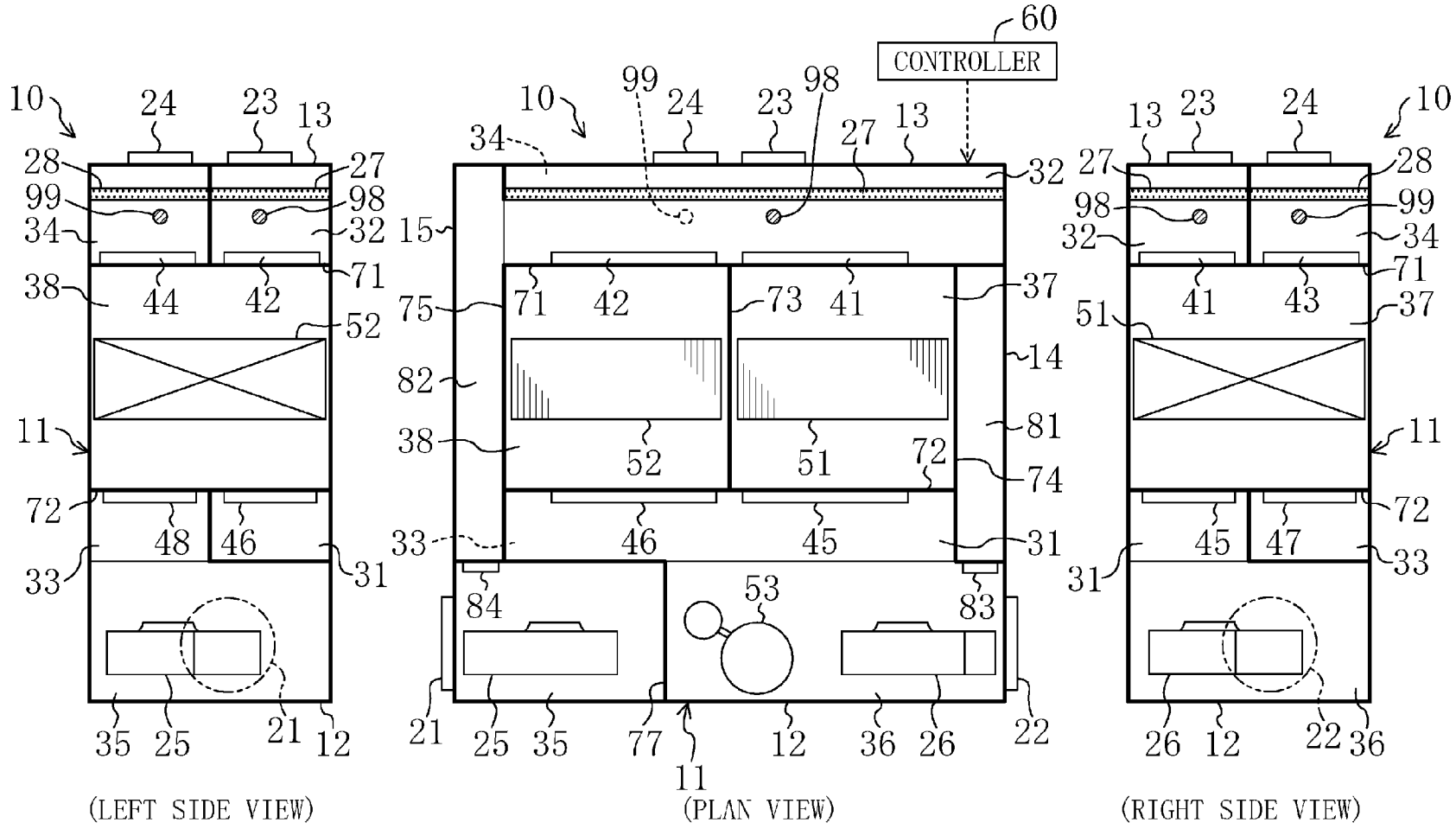
FIG. 4 illustrates a schematic plan view, a right side view, and a left side view illustrating the humidity controlling ventilator, omitting a part thereof.

Note that the first bypass passageway (81), the second bypass passageway (82), the first bypass damper (83), and the second bypass damper (84) are not shown in the right side view and the left side view of FIG. 4.

An electrical component box (90) is attached to a portion of the front surface panel portion (12) of the casing (11) closer to the right side. Note that the electrical component box (90) is omitted in FIGS. 2 and 4. The electrical component box (90) is a box of a rectangular parallelepiped shape, and accommodates therein a control substrate (91) and a power supply substrate (92). The control substrate (91) and the power supply substrate (92) are attached to the inner surface of one of the side plates of the electrical component box (90) that is adjacent to the front surface panel portion (12) (i.e., the rear plate). An inverter portion of the power supply substrate (92) is provided with radiator fins (93). The radiator fins (93) are protruding from the rear surface of the power supply substrate (92), and run through the rear plate of the electrical component box (90) and the front surface panel portion (12) of the casing (11) so as to be exposed to the air supply fan chamber (36) (see FIG. 3).

<Configuration of Refrigerant Circuit>

Figure 5:
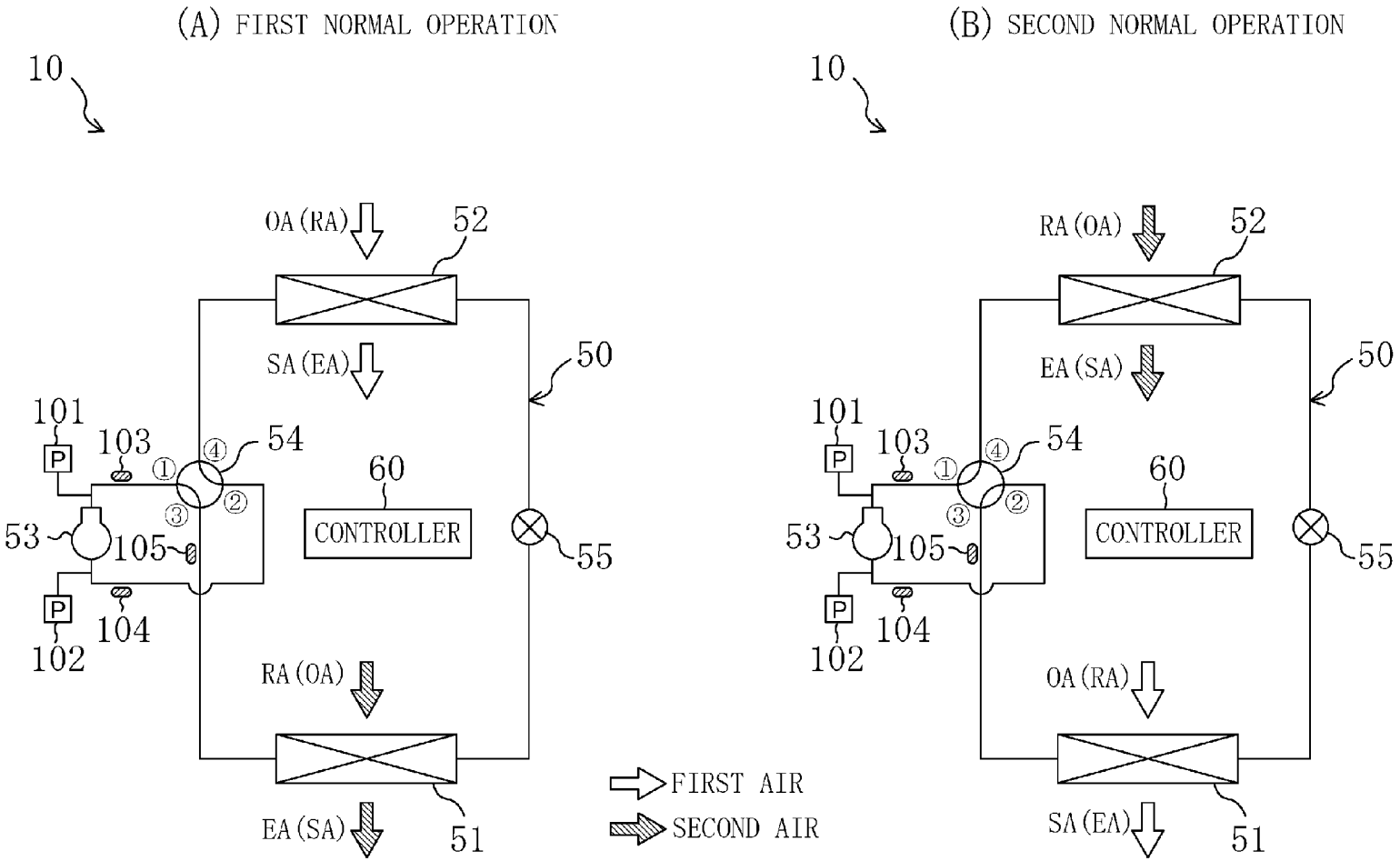
FIGS. 5(A) and 5(B) are piping system diagrams illustrating the configuration of a refrigerant circuit, where

As illustrated in FIG. 5, the refrigerant circuit (50) is a closed circuit provided with the first adsorption heat exchanger (51), the second adsorption heat exchanger (52), the compressor (53), the four-way switching valve (54), and the electric expansion valve (55). The refrigerant circuit (50) allows refrigerant, filling the refrigerant circuit (50), to circulate therethrough to perform a vapor-compression refrigeration cycle.

In the refrigerant circuit (50), the compressor (53) has its discharge side connected to the first port of the four-way switching valve (54), and its suction side connected to the second port of the four-way switching valve (54). In the refrigerant circuit (50), the first adsorption heat exchanger (51), the electric expansion valve (55), and the second adsorption heat exchanger (52) are connected sequentially from the third port of the four-way switching valve (54) to the fourth port thereof.

The four-way switching valve (54) can be switched between a first state (the state shown in FIG. 5(A)) in which the first port and the third port communicate with each other and the second port and the fourth port communicate with each other, and a second state (the state shown in FIG. 5(B)) in which the first port and the fourth port communicate with each other and the second port and the third port communicate with each other.

The compressor (53) is a hermetic compressor in which a compression mechanism configured to compress a refrigerant and an electric motor configured to drive the compression mechanism are accommodated in a single casing. A change in the frequency of alternating current fed to the electric motor of the compressor (51) (i.e., the operating frequency of the compressor (53)) changes the rotational speed of the compression mechanism driven by the electric motor, thereby changing the amount of the refrigerant discharged from the compressor (53) per unit time. That is, the capacity of the compressor (53) can be varied.

In the refrigerant circuit (50), a pipe connecting the discharge side of the compressor (53) and the first port of the four-way switching valve (54) together is provided with a high pressure sensor (101) and a discharge pipe temperature sensor (103). The high pressure sensor (101) measures the pressure of the refrigerant discharged from the compressor (53). The discharge pipe temperature sensor (103) measures the temperature of the refrigerant discharged from the compressor (53).

In the refrigerant circuit (50), a pipe connecting the suction side of the compressor (53) and the second port of the four-way switching valve (54) together is provided with a low pressure sensor (102) and a suction pipe temperature sensor (104). The low pressure sensor (102) measures the pressure of the refrigerant sucked into the compressor (53). The suction pipe temperature sensor (104) measures the temperature of the refrigerant sucked into the compressor (53).

In the refrigerant circuit (50), a pipe connecting the third port of the four-way switching valve (54) and the first adsorption heat exchanger (51) together is provided with a pipe temperature sensor (105). The pipe temperature sensor (105) is placed at a location along the pipe and in the vicinity of the four-way switching valve (54) to measure the temperature of the refrigerant flowing through the pipe.

<Configuration of Controller>

The humidity controlling ventilator (10) is provided with a controller (60) serving as a control unit. In the humidity controlling ventilator (10) of this embodiment, a microcontroller provided on the control substrate (91) forms the controller (60). Values measured by the room air humidity sensor (96), the room air temperature sensor (98), the outside air humidity sensor (97), and the outside air temperature sensor (99) are fed to the controller (60). In addition, values measured by the sensors (101, 102, . . . ) provided within the refrigerant circuit (50) are also fed to the controller (60). Furthermore, the power consumed by each of the air supply fan (26) and the exhaust fan (25), and the rotational speeds of the fans (26) and (25) are fed to the controller (60). The controller (60) includes an air flow rate calculator (62), a fan controller (63), and a humidity control controller (61).

The air flow rate calculator (62) is configured to calculate the air volume flow rate of each of the air supply fan (26) and the exhaust fan (25), and forms an air flow rate calculator according to the present invention. The air flow rate calculator (62) previously stores the relationship between each of the air temperature and humidity and the specific volume of air. The air volume flow rate in this embodiment refers to the volume ($m^3/s$) of air blown by a fan per unit time. The specific volume in this embodiment refers to the volume ($m^3/kg$) occupied by air having a mass of 1 kg.

Specifically, the air flow rate calculator (62) calculates the temperature and humidity (EA temperature and EA humidity) of air (fan suction air) sucked and blown by the exhaust fan (25) based on values measured by the room air temperature sensor (98) and the room air humidity sensor (96) (RA temperature and RA humidity) and the frequency of the compressor (53). Air sucked by the exhaust fan (25) refers to air (EA) located downstream (on the secondary side) of a corresponding one of the adsorption heat exchangers (51, 52) and discharged to the outside. The specific volume (EA specific volume) of the air sucked by the exhaust fan (25) is calculated based on the EA temperature and humidity. Furthermore, the air flow rate calculator (62) calculates the suction air (EA) mass flow rate (EA mass flow rate) of the exhaust fan (25) based on the power consumed by the exhaust fan (25) and the rotational speed of the exhaust fan (25). The air mass flow rate in this embodiment refers to the mass (kg/s) of air blown by a fan per unit time. The air flow rate calculator (62) calculates the suction air volume flow rate (EA volume flow rate) of the exhaust fan (25) based on the calculated EA specific volume and EA mass flow rate. In a situation where the compressor (53) is stopped (i.e., a situation where the frequency is zero), the RA specific volume based on the RA temperature and humidity upstream of a corresponding one of the adsorption heat exchangers (51, 52) becomes equal to the EA specific volume based on the EA temperature and humidity downstream of a corresponding one of the adsorption heat exchangers (51, 52).

In contrast, the air flow rate calculator (62) calculates the temperature and humidity (SA temperature and SA humidity) of air (fan suction air) sucked and blown by the air supply fan (26) based on values measured by the outside air temperature sensor (99) and the outside air humidity sensor (97) (OA temperature and OA humidity) and the frequency of the compressor (53). Air sucked by the air supply fan (26) refers to air (SA) located downstream (on the secondary side) of a corresponding one of the adsorption heat exchangers (51, 52) and supplied into the room. The specific volume (SA specific volume) of air sucked by the air supply fan (26) is calculated based on the SA temperature and humidity. Furthermore, the air flow rate calculator (62) calculates the suction air (SA) mass flow rate (SA mass flow rate) of the air supply fan (26) based on the power consumed by the air supply fan (26) and the rotational speed of the air supply fan (26). The air flow rate calculator (62) calculates the suction air volume flow rate (SA volume flow rate) of the air supply fan (26) based on the calculated SA specific volume and SA mass flow rate. In a situation where the compressor (53) is stopped (i.e., a situation where the frequency is zero), the OA specific volume based on the OA temperature and humidity upstream of a corresponding one of the adsorption heat exchangers (51, 52) becomes equal to the SA specific volume based on the SA temperature and humidity downstream of a corresponding one of the adsorption heat exchangers (51, 52).

The fan controller (63) controls the fans (25, 26) such that the air volume flow rates of the fans (25, 26) calculated by the air flow rate calculator (62) approach corresponding predetermined target volume flow rates, and forms an air blow controller according to the present invention. Specifically, the above-described volume flow rates of air blown by the air supply fan (26) and the exhaust fan (25), which are calculated by the air flow rate calculator (62), are fed to the fan controller (63). The fan controller (63) previously stores the predetermined target volume flow rates. The target volume flow rates form target volume flow rates according to the present invention. The fan controller (63) is configured to control the rotational speeds of the air supply fan (26) and the exhaust fan (25) such that the calculated volume flow rates approach the corresponding target volume flow rates.

The humidity control controller (61) controls operation of the humidity controlling ventilator (10) based on the fed measured values. In the humidity controlling ventilator (10), one of a dehumidifying ventilation mode, a humidifying ventilation mode, and a simple ventilation mode all described below is selected by control operation of the humidity control controller (61). The humidity control controller (61) controls operations of the dampers (41-48), the fans (25, 26), the compressor (53), the electric expansion valve (55), and the four-way switching valve (54) in each of the modes.

—Operating Modes—

The humidity controlling ventilator (10) of this embodiment selectively performs one of the dehumidifying ventilation mode, the humidifying ventilation mode, and the simple ventilation mode. The humidity controlling ventilator (10) performs the dehumidifying ventilation mode and the humidifying ventilation mode as normal modes.

<Dehumidifying Ventilation Mode>

The humidity controlling ventilation device (10) in the dehumidifying ventilation mode performs a first normal operation and a second normal operation, which will be described below, alternately with each other at intervals of a predetermined period (e.g., at intervals of 3-4 min). In the dehumidifying ventilation mode, the first bypass damper (83) and the second bypass damper (84) are always closed.

In the humidity controlling ventilator (10) in the dehumidifying ventilation mode, the outside air is taken into the casing (11) through the outside-air inlet (24) as the first air, and the room air is taken into the casing (11) through the room-air inlet (23) as the second air.

Figure 6:
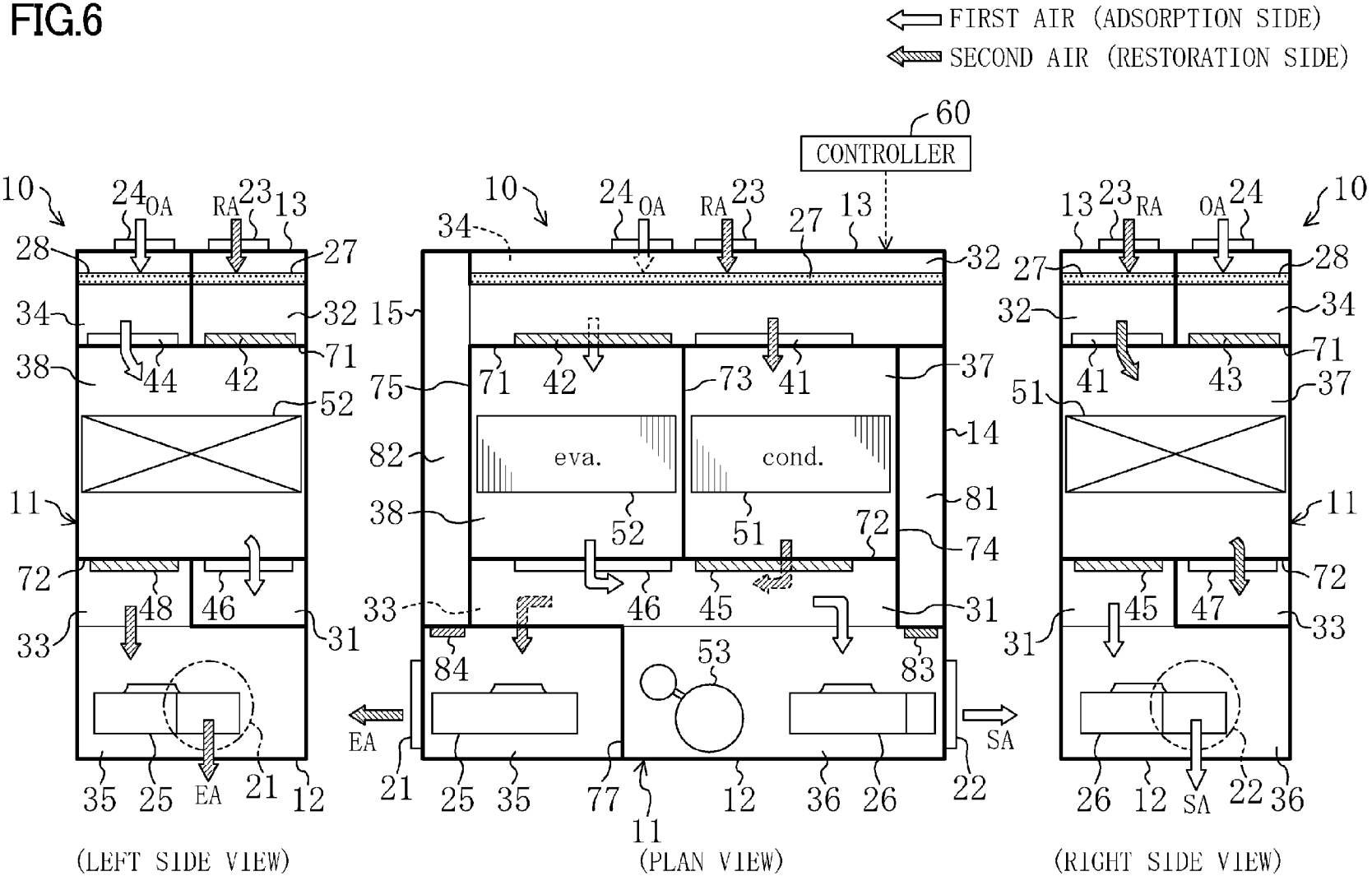
FIG. 6 illustrates a schematic plan view, a right side view, and a left side view of the humidity controlling ventilator illustrating the flow of the air in the first normal operation of a dehumidifying ventilation mode.

First, the first normal operation of the dehumidifying ventilation mode will be described. As illustrated in FIG. 6, in the first normal operation, the first room air-side damper (41), the second outside air-side damper (44), the second air-supply-side damper (46), and the first exhaust-side damper (47) are open, and the second room air-side damper (42), the first outside air-side damper (43), the first air-supply-side damper (45), and the second exhaust-side damper (48) are closed. In the refrigerant circuit (50) in the first normal operation, the four-way switching valve (54) is set in the first state (as illustrated in FIG. 5(A)), the first adsorption heat exchanger (51) serves as a condenser, and the second adsorption heat exchanger (52) serves as an evaporator.

The first air, which has flowed into the outside air-side passageway (34) and has passed through the outside air-side filter (28), flows into the second heat exchanger chamber (38) through the second outside air-side damper (44), and then passes through the second adsorption heat exchanger (52). In the second adsorption heat exchanger (52), the moisture of the first air is adsorbed by the adsorbent, with the resulting heat of adsorption being absorbed by the refrigerant. The first air, which has been dehumidified through the second adsorption heat exchanger (52), flows into the air-supply-side passageway (31) through the second air-supply-side damper (46), and is supplied into the room through the air supply opening (22) after passing through the air supply fan chamber (36).

On the other hand, the second air, which has flowed into the room air-side passageway (32) and has passed through the room air-side filter (27), flows into the first heat exchanger chamber (37) through the first room air-side damper (41), and then passes through the first adsorption heat exchanger (51). In the first adsorption heat exchanger (51), the moisture is desorbed from the adsorbent heated by the refrigerant, and the desorbed moisture is given to the second air. The second air, which has been given the moisture through the first adsorption heat exchanger (51), flows into the exhaust-side passageway (33) through the first exhaust-side damper (47), and is discharged to the outside through the exhaust opening (21) after passing through the exhaust fan chamber (35).

Figure 7:
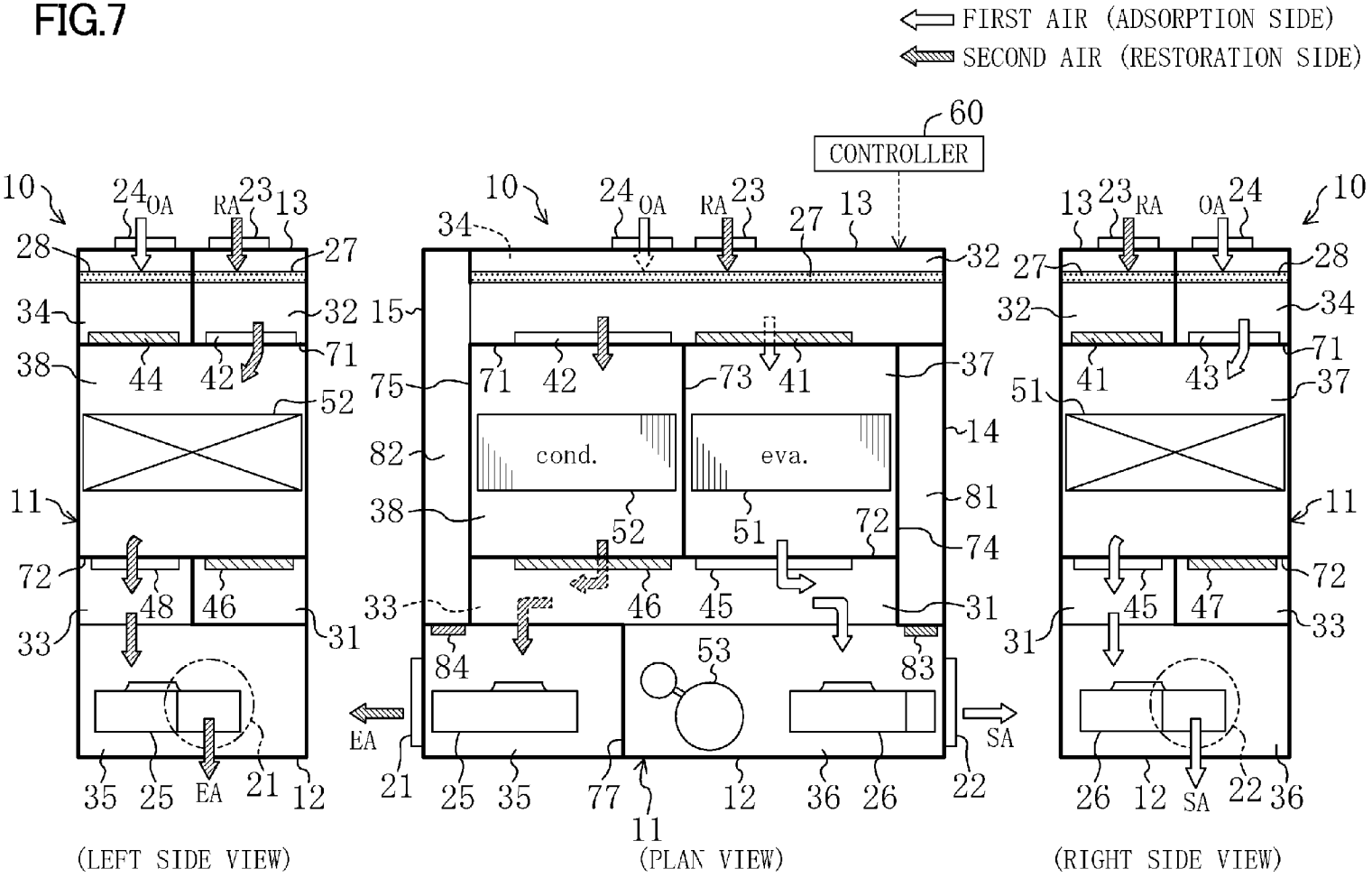
FIG. 7 illustrates a schematic plan view, a right side view, and a left side view of the humidity controlling ventilator illustrating the flow of the air in the second normal operation of the dehumidifying ventilation mode.

Next, the second normal operation in the dehumidifying ventilation mode will be described. As illustrated in FIG. 7, in the second normal operation, the second room air-side damper (42), the first outside air-side damper (43), the first air-supply-side damper (45), and the second exhaust-side damper (48) are open, and the first room air-side damper (41), the second outside air-side damper (44), the second air-supply-side damper (46), and the first exhaust-side damper (47) are closed. In the refrigerant circuit (50) in the second normal operation, the four-way switching valve (54) is set in the second state (as illustrated in FIG. 5(B)), the first adsorption heat exchanger (51) serves as the evaporator, and the second adsorption heat exchanger (52) serves as the condenser.

The first air, which has flowed into the outside air-side passageway (34) and has passed through the outside air-side filter (28), flows into the first heat exchanger chamber (37) through the first outside air-side damper (43), and then passes through the first adsorption heat exchanger (51). In the first adsorption heat exchanger (51), the moisture of the first air is adsorbed by the adsorbent, with the resulting heat of adsorption being absorbed by the refrigerant. The first air, which has been dehumidified through the first adsorption heat exchanger (51), flows into the air-supply-side passageway (31) through the first air-supply-side damper (45), and is supplied into the room through the air supply opening (22) after passing through the air supply fan chamber (36).

On the other hand, the second air, which has flowed into the room air-side passageway (32) and has passed through the room air-side filter (27), flows into the second heat exchanger chamber (38) through the second room air-side damper (42), and then passes through the second adsorption heat exchanger (52). In the second adsorption heat exchanger (52), the moisture is desorbed from the adsorbent heated by the refrigerant, and the desorbed moisture is given to the second air. The second air, which has been given the moisture through the second adsorption heat exchanger (52), flows into the exhaust-side passageway (33) through the second exhaust-side damper (48), and is discharged to the outside through the exhaust opening (21) after passing through the exhaust fan chamber (35).

<Humidifying Ventilation Mode>

The humidity controlling ventilator (10) in the humidifying ventilation mode performs a first normal operation and a second normal operation, which will be described below, alternately with each other at intervals of a predetermined period (e.g., at intervals of 3-4 min). In the humidifying ventilation mode, the first bypass damper (83) and the second bypass damper (84) are always closed.

In the humidity controlling ventilator (10) in the humidifying ventilation mode, the outside air is taken into the casing (11) through the outside-air inlet (24) as the second air, and the room air is taken into the casing (11) through the room-air inlet (23) as the first air.

Figure 8:
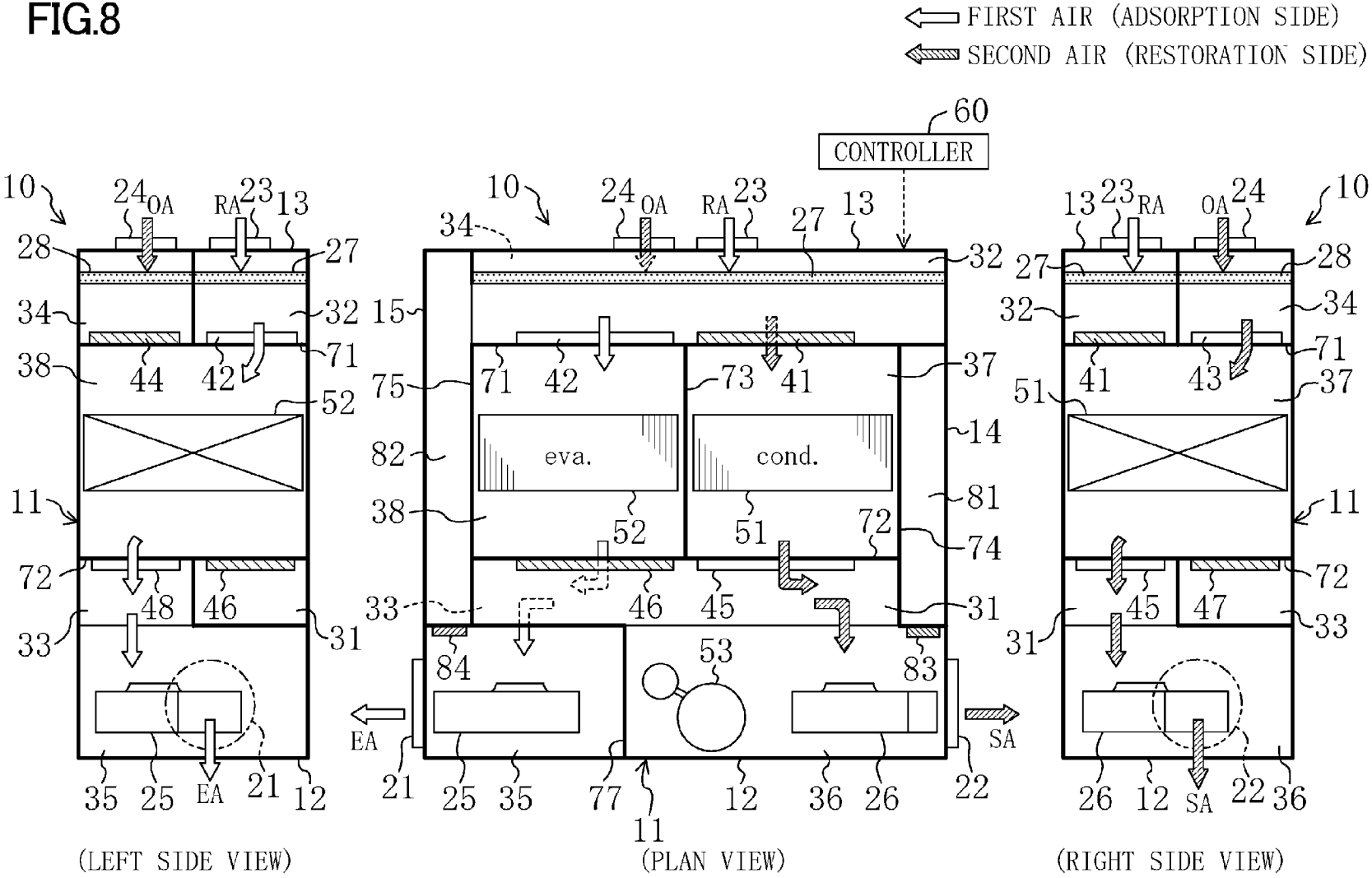
FIG. 8 illustrates a schematic plan view, a right side view, and a left side view of the humidity controlling ventilator illustrating the flow of the air in the first normal operation of a humidifying ventilation mode.

First, the first normal operation of the humidifying ventilation mode will be described. As illustrated in FIG. 8, in the first normal operation, the second room air-side damper (42), the first outside air-side damper (43), the first air-supply-side damper (45), and the second exhaust-side damper (48) are open, and the first room air-side damper (41), the second outside air-side damper (44), the second air-supply-side damper (46), and the first exhaust-side damper (47) are closed. In the refrigerant circuit (50) in the first normal operation, the four-way switching valve (54) is set in the first state (as illustrated in FIG. 5(A)), the first adsorption heat exchanger (51) serves as the condenser, and the second adsorption heat exchanger (52) serves as the evaporator.

The first air, which has flowed into the room air-side passageway (32) and has passed through the room air-side filter (27), flows into the second heat exchanger chamber (38) through the second inside air-side damper (42), and then passes through the second adsorption heat exchanger (52). In the second adsorption heat exchanger (52), the moisture of the first air is adsorbed by the adsorbent, with the resulting heat of adsorption being absorbed by the refrigerant. The first air, which has been deprived of the moisture through the second adsorption heat exchanger (52), flows into the exhaust-side passageway (33) through the second exhaust-side damper (48), and is discharged to the outside through the exhaust opening (21) after passing through the exhaust fan chamber (35).

On the other hand, the second air, which has flowed into the outside air-side passageway (34) and has passed through the outside air-side filter (28), flows into the first heat exchanger chamber (37) through the first outside air-side damper (43), and then passes through the first adsorption heat exchanger (51). In the first adsorption heat exchanger (51), the moisture is desorbed from the adsorbent heated by the refrigerant, and the desorbed moisture is given to the second air. The second air, which has been humidified through the first adsorption heat exchanger (51), flows into the air-supply-side passageway (31) through the first air-supply-side damper (45), and is supplied into the room through the air supply opening (22) after passing through the air supply fan chamber (36).

Figure 9:
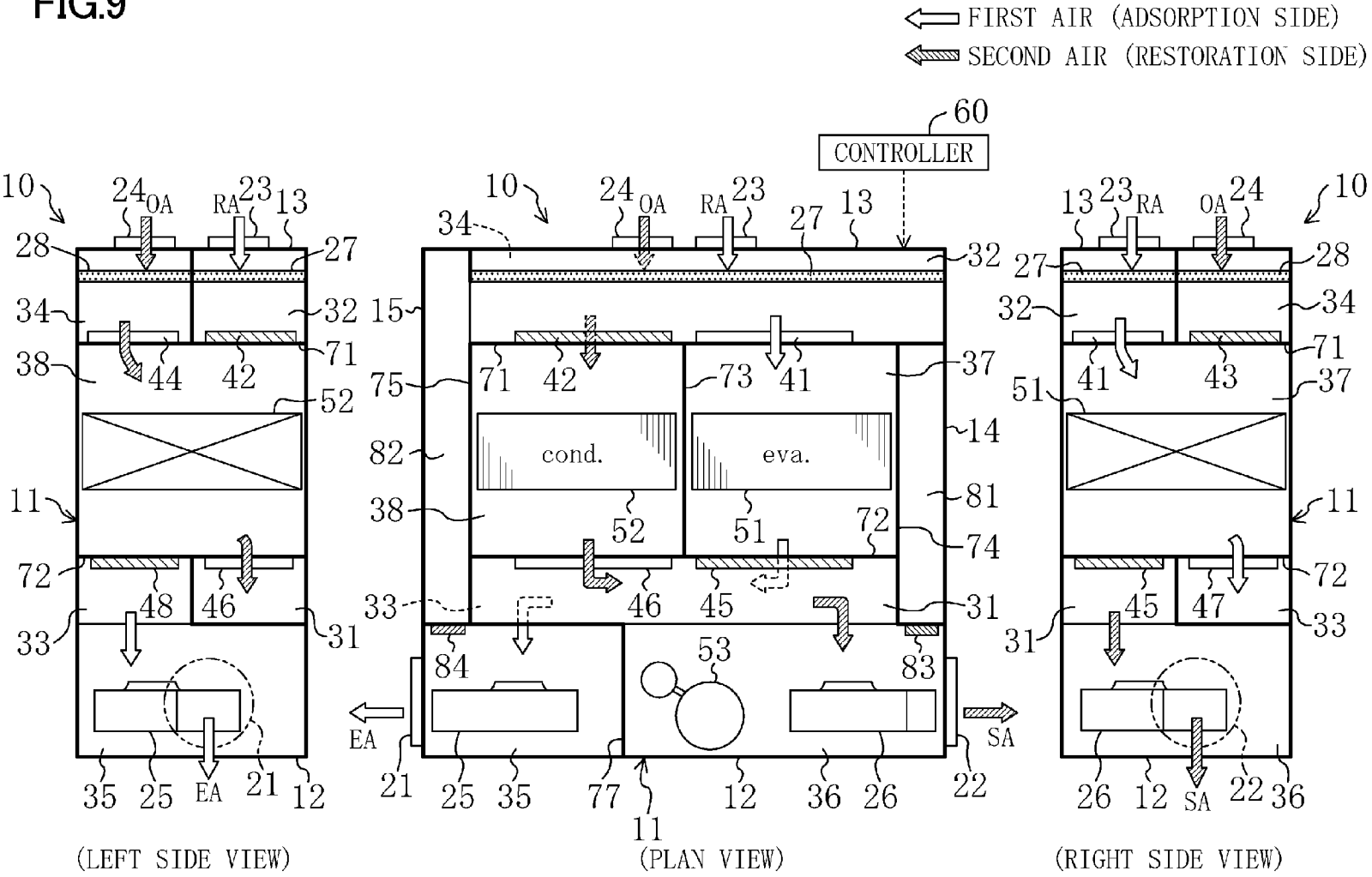
FIG. 9 illustrates a schematic plan view, a right side view, and a left side view of the humidity controlling ventilator illustrating the flow of the air in the second normal operation of the humidifying ventilation mode.

Next, the second normal operation in the humidifying ventilation mode will be described. As illustrated in FIG. 9, in the second normal operation, the first room air-side damper (41), the second outside air-side damper (44), the second air-supply-side damper (46), and the first exhaust-side damper (47) are open, and the second room air-side damper (42), the first outside air-side damper (43), the first air-supply-side damper (45), and the second exhaust-side damper (48) are closed. In the refrigerant circuit (50) in the second normal operation, the four-way switching valve (54) is set in the second state (as illustrated in FIG. 5(B)), the first adsorption heat exchanger (51) serves as the evaporator, and the second adsorption heat exchanger (52) serves as the condenser.

The first air, which has flowed into the room air-side passageway (32) and has passed through the room air-side filter (27), flows into the first heat exchanger chamber (37) through the first room air-side damper (41), and then passes through the first adsorption heat exchanger (51). In the first adsorption heat exchanger (51), the moisture of the first air is adsorbed by the adsorbent, with the resulting heat of adsorption being absorbed by the refrigerant. The first air, which has been deprived of the moisture through the first adsorption heat exchanger (51), flows into the exhaust-side passageway (33) through the first exhaust-side damper (47), and is discharged to the outside through the exhaust opening (21) after passing through the exhaust fan chamber (35).

On the other hand, the second air, which has flowed into the outside air-side passageway (34) and has passed through the outside air-side filter (28), flows into the second heat exchanger chamber (38) through the second outside air-side damper (44), and then passes through the second adsorption heat exchanger (52). In the second adsorption heat exchanger (52), the moisture is desorbed from the adsorbent heated by the refrigerant, and the desorbed moisture is given to the second air. The second air, which has been humidified through the second adsorption heat exchanger (52), flows into the air-supply-side passageway (31) through the second air-supply-side damper (46), and is supplied into the room through the air supply opening (22) after passing through the air supply fan chamber (36).

<Simple Ventilation Mode>

Figure 10:
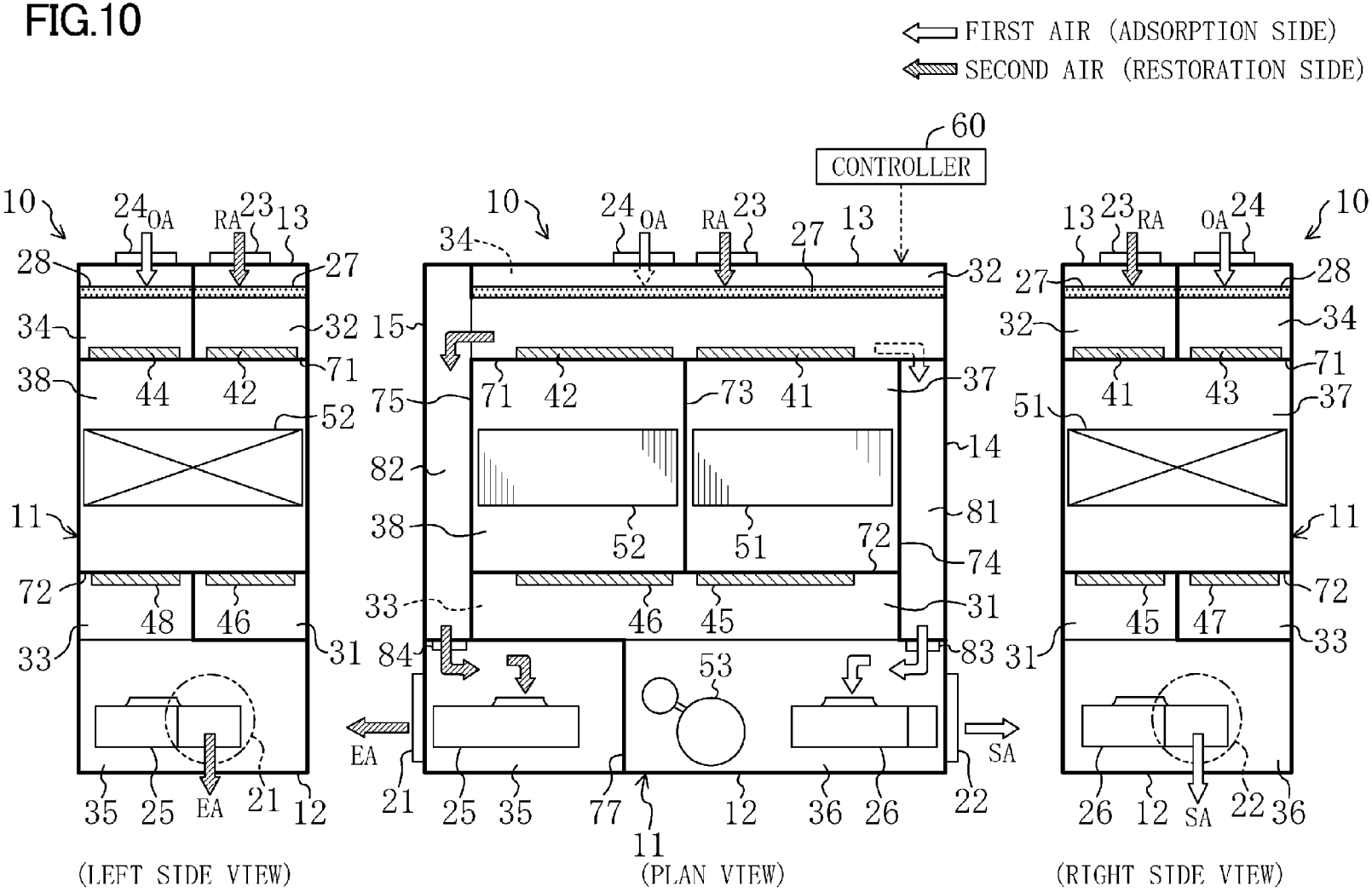
FIG. 10 illustrates a schematic plan view, a right side view, and a left side view of the humidity controlling ventilator illustrating the flow of the air in a simple ventilation mode.

The humidity controlling ventilator (10) in the simple ventilation mode supplies taken outside air (OA) itself as supply air (SA) into the room, and simultaneously discharges taken room air (RA) itself as ejection air (EA) to the outside. Here, the operation of the humidity controlling ventilator (10) in the simple ventilation mode will be described with reference to FIG. 10.

In the humidity controlling ventilator (10) in the simple ventilation mode, the first bypass damper (83) and the second bypass damper (84) are open, and the first room air-side damper (41), the second room air-side damper (42), the first outside air-side damper (43), the second outside air-side damper (44), the first air-supply-side damper (45), the second air-supply-side damper (46), the first exhaust-side damper (47), and the second exhaust-side damper (48) are closed. In the simple ventilation mode, the compressor (53) of the refrigerant circuit (50) is shut down.

In the humidity controlling ventilator (10) in the simple ventilation mode, the outside air is taken into the casing (11) through the outside-air inlet (24). The outside air, which has flowed into the outside air-side passageway (34) through the outside-air inlet (24), flows into the air supply fan chamber (36) through the first bypass passageway (81) and the first bypass damper (83), and is then supplied into the room through the air supply opening (22).

In the humidity controlling ventilator (10) in the simple ventilation mode, the room air is taken into the casing (11) through the room-air inlet (23). The room air, which has flowed into the room air-side passageway (32) through the room-air inlet (23), flows into the exhaust fan chamber (35) through the second bypass passageway (82) and the second bypass damper (84), and is then discharged to the outside through the exhaust opening (21).

<Fan Control Operation>

Figure 11:
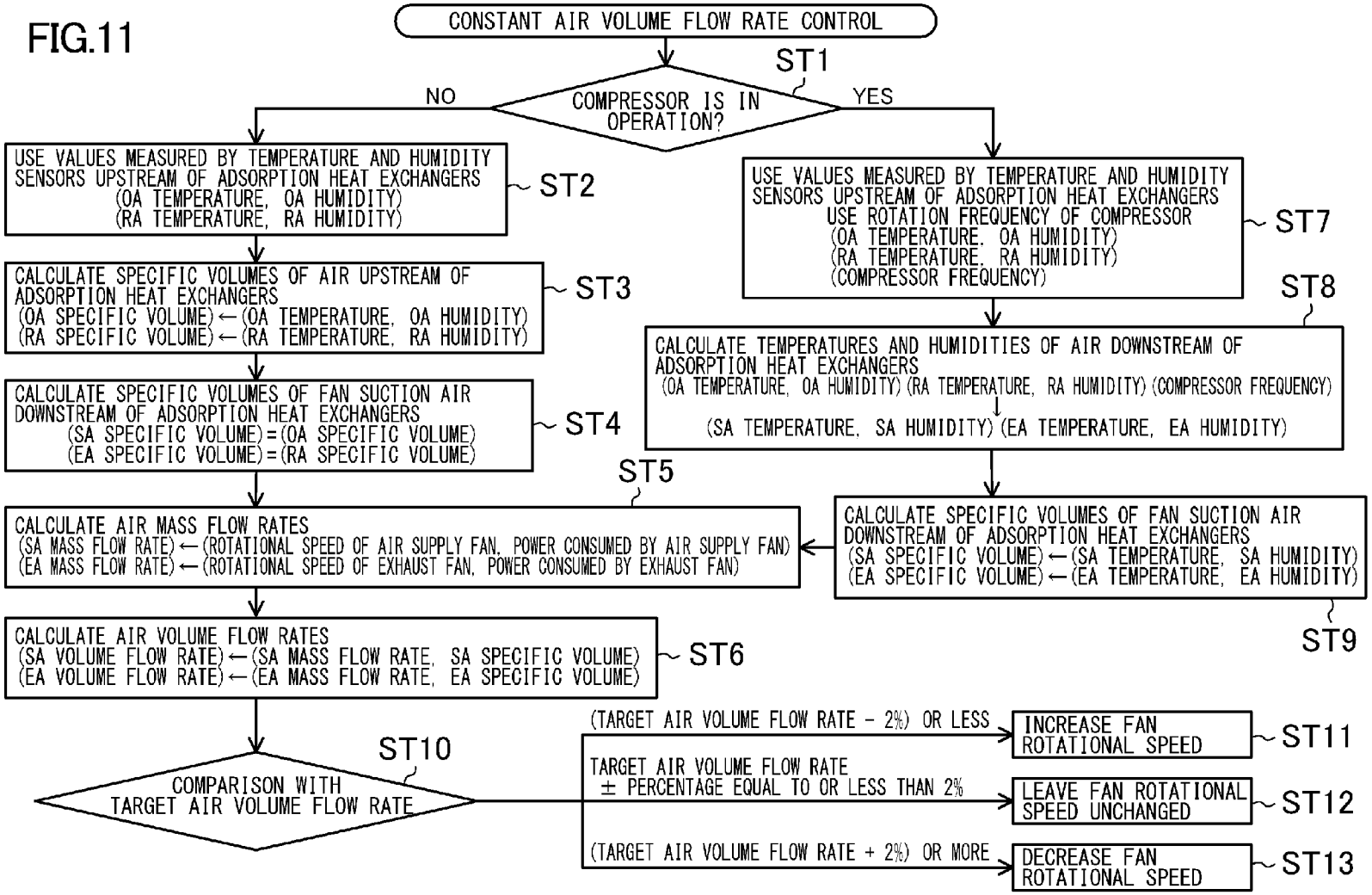
FIG. 11 is a flow chart illustrating a control operation of an air blowing fan.

Next, a control operation for the fans (25, 26) will be described with reference to FIG. 11. The fans (25, 26) are controlled such that their air volume flow rates are kept constant. In other words, constant air flow rate control is performed. In the constant air flow rate control of this embodiment, the volume flow rates of air blown by the fans (25, 26) are calculated by the air flow rate calculator (62), and the air flow rates of the fans (25, 26) are controlled by the fan controller (63) such that the volume flow rates of air blown by the fans (25, 26) are kept constant. Here, an operating procedure (ST1-ST9) of the air flow rate calculator (62) will be described. The air flow rate calculator (62) initially determines whether or not the compressor (53) is in operation (ST1). A situation where the compressor (53) is in operation and a situation where the compressor (53) is not in operation will be separately described.

When the compressor (53) is not in operation, the air flow rate calculator (62) measures the temperature (RA temperature) and humidity (RA humidity) of room air (RA) using the room air temperature sensor (98) and the room air humidity sensor (96), and measures the temperature (OA temperature) and humidity (OA humidity) of outside air (OA) using the outside air temperature sensor (99) and the outside air humidity sensor (97) (ST2). Next, the air flow rate calculator (62) calculates the specific volumes (OA specific volume and RA specific volume) of the outside air (OA) and the room air (RA) based on the measured temperatures and humidities (OA temperature, OA humidity, RA temperature, and RA humidity) of the outside air (OA) and the room air (RA) (ST3). Next, the air flow rate calculator (62) calculates the specific volume (SA specific volume) of air sucked by the air supply fan (26) (ST4), and the SA specific volume is equal to the calculated specific volume (OA specific volume) of the outside air (OA). Furthermore, the air flow rate calculator (62) calculates the specific volume (EA specific volume) of air sucked by the exhaust fan (25) (ST4), and the EA specific volume is equal to the calculated specific volume (RA specific volume) of the room air (RA).

Next, the air flow rate calculator (62) calculates the mass flow rates (SA mass flow rate and EA mass flow rate) of the air sucked by the air supply fan (26) and the exhaust fan (25) based on the rotational speeds of the air supply fan (26) and the exhaust fan (25) and power consumed by the fans (26, 25) (ST5). Then, the air flow rate calculator (62) calculates the volume flow rate (SA volume flow rate) of the air sucked by the air supply fan (26) based on the calculated SA specific volume and SA mass flow rate. Furthermore, the air flow rate calculator (62) calculates the volume flow rate (EA volume flow rate) of the air sucked by the exhaust fan (25) based on the calculated EA specific volume and EA mass flow rate (ST6).

When the compressor is in operation, the air flow rate calculator (62) measures the temperature and humidity (RA temperature and RA humidity) of room air using the room air temperature sensor (98) and the room air humidity sensor (96), and measures the temperature and humidity (OA temperature and OA humidity) of outside air (OA) using the outside air temperature sensor (99) and the outside air humidity sensor (97) (ST7). The air flow rate calculator (62) reads the frequency of the compressor (53) (ST7). Next, the air flow rate calculator (62) calculates the temperatures and humidities (SA temperature, SA humidity, EA temperature, and EA humidity) of air (SA, EA) sucked by the air supply fan (26) and the exhaust fan (25) based on the measured temperatures and humidities (OA temperature, OA humidity, RA temperature, and RA humidity) of outside air (OA) and room air (RA) and the frequency of the compressor (53) (ST8). Then, the air flow rate calculator (62) calculates the specific volumes (SA specific volume and EA specific volume) of the air (SA, EA) sucked by the air supply fan (26) and the exhaust fan (25) based on the calculated temperatures and humidities (SA temperature, SA humidity, EA temperature, and EA humidity) (ST9).

Next, the air flow rate calculator (62) calculates the mass flow rates (SA mass flow rate and EA mass flow rate) of the air sucked by the air supply fan (26) and the exhaust fan (25) based on the rotational speeds of the air supply fan (26) and the exhaust fan (25) and power consumed by the fans (26, 25) (ST5). Next, the air flow rate calculator (62) calculates the volume flow rate (SA volume flow rate) of the air (SA) sucked by the air supply fan (26) based on the calculated SA specific volume and SA mass flow rate. The air flow rate calculator (62) calculates the volume flow rate (EA volume flow rate) of the air (EA) sucked by the exhaust fan (25) based on the calculated EA specific volume and EA mass flow rate (ST6).

Next, an operating procedure (ST10-ST13) of the fan controller (63) will be described. The fan controller (63) compares each of the SA volume flow rate and the EA volume flow rate with a corresponding target air volume flow rate (ST10). In this case, when the SA volume flow rate is equal to or less than a value that is 2% lower than the corresponding target air volume flow rate (target air volume flow rate−2%), the fan controller (63) increases the rotational speed of the air supply fan (26), thereby allowing the SA volume flow rate to be closer to the corresponding target air volume flow rate (ST11). When the EA volume flow rate is equal to or less than a value that is 2% lower than the corresponding target air volume flow rate (target air volume flow rate−2%), the fan controller (63) increases the rotational speed of the exhaust fan (25), thereby allowing the EA volume flow rate to be closer to the corresponding target air volume flow rate (ST11).

The fan controller (63) compares each of the SA volume flow rate and the EA volume flow rate with a corresponding target air volume flow rate (ST10), and when the SA volume flow rate is greater than or equal to a value that is 2% higher than the corresponding target air volume flow rate (target air volume flow rate+2%), the fan controller (63) decreases the rotational speed of the air supply fan (26), thereby allowing the SA volume flow rate to be closer to the corresponding target air volume flow rate (ST13). When the EA volume flow rate is greater than or equal to a value that is 2% higher than the corresponding target air volume flow rate (target air volume flow rate+2%), the fan controller (63) decreases the rotational speed of the exhaust fan (25), thereby allowing the EA volume flow rate to be closer to the corresponding target air volume flow rate (ST13).

The fan controller (63) compares each of the SA volume flow rate and the EA volume flow rate with a corresponding target air volume flow rate (ST10), and when the difference between each of the SA volume flow rate and the EA volume flow rate and the corresponding target air volume flow rate is less than or equal to 2% (target air volume flow rate±2%), the fan controller (63) does not change the rotational speeds of the air supply fan (26) and the exhaust fan (25) (ST12).

Advantages of Embodiment

According to this embodiment, the air flow rates of the air supply fan (26) and the exhaust fan (25) are controlled based on the corresponding air volume flow rates, and thus, even when the temperatures of air sucked by the fans are changed, the air flow rates of both of the fans (25, 26) can be controlled.

Here, fans have been conventionally controlled based on the corresponding air mass flow rates. In this case, when the air temperature increases, and the air volume flow rate increases, the air flow rate of a corresponding fan is too high, and thus, the loss through a duct increases. On the other hand, when the air temperature decreases, and the air volume flow rate decreases, the air flow rate of the fan becomes inadequate, and thus, the amount of ventilation becomes inadequate. In other words, when the fan is controlled based on the air mass flow rate, a change in the air temperature causes the air flow rate to be too high or too low.

However, according to this embodiment, since the air volume flow rates of the air supply fan (26) and the exhaust fan (25) are brought closer to the corresponding target air volume flow rates, the flow rates of air flowed by the air supply fan (26) and the exhaust fan (25) can be controlled to remain constant even with a change in the air temperature. This can reliably prevent the flow rates of the air flowed by the air supply fan (26) and the exhaust fan (25) from being too high or too low due to a change in the air temperature.

The specific volume of air located downstream of each of the first and second adsorption heat exchangers (51) and (52) is calculated based on the temperature and humidity of air located upstream of a corresponding one of the first and second adsorption heat exchangers (51) and (52); therefore, the specific volume of the air located downstream of each of the first and second adsorption heat exchangers (51) and (52) can be calculated without detecting the temperature and humidity of the air with, e.g., a sensor. This can reduce a temperature sensor and a humidity sensor required downstream of each of the first and second adsorption heat exchangers (51) and (52) only to calculate the specific volume of the air.

Furthermore, the air mass flow rate of each of the air supply fan (26) and the exhaust fan (25) is calculated based on the power consumed by a corresponding one of the air supply fan (26) and the exhaust fan (25) and the rotational speed of the corresponding fan; therefore, the air mass flow rate of each of the air supply fan (26) and the exhaust fan (25) can be easily and reliably calculated.

Finally, the air flow rate of each of the air supply fan (26) and the exhaust fan (25) is controlled based on the corresponding air volume flow rate; therefore, even when air passes through each of the adsorption heat exchangers (51, 52), and the air temperature changes, the flow rates of air flowed by the air supply fan (26) and the exhaust fan (25) can be controlled. This can reliably prevent the flow rates of the air flowed by the air blowing fans (25, 26) from being too high or too low due to a change in the air temperature.

Other Embodiments

In the present invention, the embodiment may be configured as follows.

In the embodiment, for example, a material principally capable of adsorbing water vapor, such as zeolite or silica gel, is used as the adsorbent. However, in the present invention, the adsorbent is not limited to the material, and a material capable of both adsorbing and absorbing water vapor (a so-called sorbent) may be used.

Specifically, in another embodiment of the present invention, a hygroscopic organic polymeric material is used as an adsorbent. In the organic polymeric material used as an adsorbent, a plurality of polymer backbones having hydrophilic polar groups in molecules are cross-linked, and the cross-linked polymer backbones form a three-dimensional structure.

The adsorbent of this embodiment swells by taking water vapor (i.e., moisture absorption). A mechanism in which this adsorbent swells by moisture absorption is assumed to be as follows. Specifically, when the adsorbent absorbs moisture, water vapor is adsorbed on hydrophilic polar groups, and an electrical load caused by reaction between the hydrophilic polar groups and water vapor acts on polymer backbones, resulting in deformation of the polymer backbones. Then, water vapor is taken in the clearance between the deformed polymer backbones due to capillarity, thereby causing the three-dimensional structures of the polymer backbones to swell. As a result, the volume of the adsorbent increases.

In this manner, with respect to the adsorbent of this embodiment, both adsorption of water vapor on the adsorbent and absorption of water vapor in the adsorbent occur. That is, water vapor is sorbed on the adsorbent. The water vapor taken by the adsorbent enters not only the surface of the three-dimensional structure of a plurality of cross-linked polymer backbones but also the inside of this three-dimensional structure. Consequently, a large amount of water vapor is taken by the adsorbent, as compared to, for example, zeolite which allows adsorption of water vapor only on its surface.

In addition, this adsorbent contracts by desorbing water vapor (i.e., desorbing moisture). Specifically, when the adsorbent desorbs moisture, the amount of water taken in the clearance between polymer backbones decreases, and the shape of the three-dimensional structure of polymer backbones gradually recovers, thereby causing the volume of the adsorbent to decrease.

The material used as the adsorbent of this embodiment is not limited to the material described above as long as the adsorbent swells by moisture absorption and contracts by moisture desorption. The material used as the adsorbent may be a hygroscopic ion-exchange resin, for example.

The embodiments are set forth merely for the purposes of preferred examples in nature, and are not intended to limit the scope, applications, and use of the invention.

INDUSTRIAL APPLICABILITY

As described above, the present invention is useful for humidity controlling ventilators each including a fan.

DESCRIPTION OF REFERENCE CHARACTERS

25 EXHAUST FAN
26 AIR SUPPLY FAN

50 REFRIGERANT CIRCUIT
51 FIRST ADSORPTION HEAT EXCHANGER
52 SECOND ADSORPTION HEAT EXCHANGER
53 COMPRESSOR
60 CONTROLLER
62 AIR FLOW RATE CALCULATOR
63 FAN CONTROLLER

The invention claimed is:

1. A humidity controlling ventilator that includes a humidity controlling member having an adsorbent and configured to bring the adsorbent into contact with air, and an air blowing fan provided downstream of the humidity controlling member to supply air to the humidity controlling member, and is configured to control a humidity of taken air using the humidity controlling member, and then supply the humidity-controlled air into a room, the humidity controlling ventilator comprising:

an air flow rate calculator configured to calculate an air volume flow rate of the air blowing fan based on a specific volume of air located downstream of the humidity controlling member and an air mass flow rate of the air blowing fan; and an air blow controller configured to control the air blowing fan such that the air volume flow rate calculated by the air flow rate calculator approaches a predetermined target air volume flow rate.

2. The humidity controlling ventilator of claim 1, wherein the air flow rate calculator is configured to calculate the specific volume of the air located downstream of the humidity controlling member based on a temperature and a humidity of air located upstream of the humidity controlling member.

3. The humidity controlling ventilator of claim 2, further comprising:

a refrigerant circuit which includes at least a compressor, and through which refrigerant is circulated to perform a refrigeration cycle, wherein the humidity controlling member is regenerated by utilizing heat released from the refrigerant of the refrigerant circuit, and the air flow rate calculator is configured to calculate the specific volume of the air located downstream of the humidity controlling member further based on a capacity of the compressor.

4. The humidity controlling ventilator of claim 1, wherein the air flow rate calculator is configured to calculate the air mass flow rate of the air blowing fan based on at least power consumed by the air blowing fan and a rotational speed of the air blowing fan.

5. The humidity controlling ventilator of claim 3, wherein first and second adsorption heat exchangers on each of which an adsorbent is carried and which are connected to the refrigerant circuit are each provided as the humidity controlling member, in each of the two adsorption heat exchangers, an adsorption action and a regeneration action of the adsorbent are alternately performed by switching a direction of circulation of the refrigerant through the refrigerant circuit between opposite directions, and a humidity of air passing through each of the adsorption heat exchangers is controlled.

6. The humidity controlling ventilator of claim 5, wherein first and second adsorption heat exchangers on each of which an adsorbent is carried and which are connected to the refrigerant circuit are each provided as the humidity controlling member, in each of the two adsorption heat exchangers, an adsorption action and a regeneration action of the adsorbent are alternately performed by switching a direction of circulation of the refrigerant through the refrigerant circuit between opposite directions, and a humidity of air passing through each of the adsorption heat exchangers is controlled.

* * * * *